United States Patent [19]

Garuti

[11] Patent Number: 5,068,032

[45] Date of Patent: Nov. 26, 1991

[54] SYSTEM FOR FIXING ANODIZED ALUMINUM

[76] Inventor: Giuseppe Garuti, No. 131 via Mantegna, 41100 Modena, Italy

[21] Appl. No.: 467,925

[22] Filed: Jan. 22, 1990

[30] Foreign Application Priority Data

Feb. 17, 1989 [IT] Italy ..... 40027 A/89

[51] Int. Cl.[5] ..... B05C 11/00

[52] U.S. Cl. ..... 210/96.1; 118/602; 210/194; 210/269

[58] Field of Search ..... 118/602, 603; 148/273; 204/37.6; 210/662, 683, 96.1, 143, 194, 263, 269, 287

[56] References Cited

U.S. PATENT DOCUMENTS

| | | | |
|---|---|---|---|
| 2,726,968 | 12/1955 | Spaulding | 210/683 |
| 3,246,759 | 4/1966 | Matalon | 210/662 |
| 3,929,612 | 12/1975 | Yanagida et al. | 204/37.6 |
| 4,647,347 | 3/1987 | Schoener et al. | 148/273 |
| 4,805,553 | 2/1989 | Krulik | 118/603 |

*Primary Examiner*—Ivars Cintins

*Attorney, Agent, or Firm*—Laff, Whitesel, Conte & Saret

[57] ABSTRACT

A system for fixing anodized aluminum surfaces comprises a bath (1) of nickel fluoride solution in which the items are immersed following anodization, and a tank (2), connected with the bath by way of flow and return pipelines (4, 5) and containing a negative ion exchange resin bed charged with F-fluorine ions; the solution is circulated between bath and tank by a recycle pump (3), and the resin bed will be recharged by a regeneration device (7) whenever the fluorine ions have been totally or almost totally replaced by other negative ions.

4 Claims, 1 Drawing Sheet

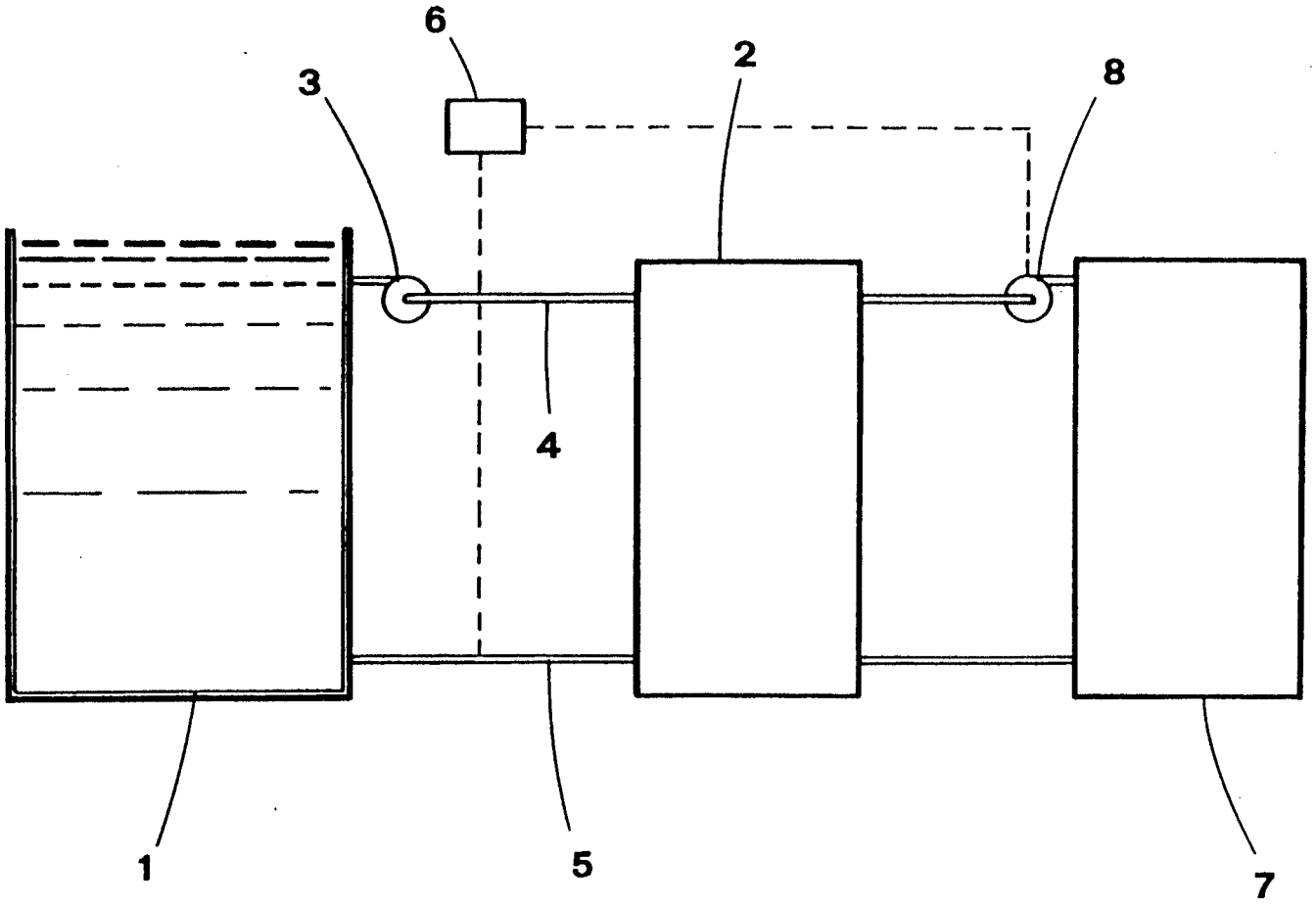
8
2
6
3
7
4
5
1

SYSTEM FOR FIXING ANODIZED ALUMINUM

BACKGROUND of the INVENTION

The present invention relates to a system for the fixing of anodized aluminum.

Following the anodization of aluminum, an oxide layer forms on the surface of the metal; this layer is porous and therefore readily open to attack from extraneous substances that cause its deterioration. Accordingly, subsequent fixing is required. The traditional method of fixing formerly employed was to immerse the anodized items in boiling water containing salts of nickel, for a period of some 20...40 minutes duration. Being slow and costly, this method has been replaced latterly by a process that is quicker and consumes less energy, whereby the anodized items are immersed in a cold bath containing predominantly nickel fluoride dissolved at a rate of 5 grams/liter.

The cold method in its turn has certain drawbacks: not only is the cost of nickel fluoride relatively high, but the nickel fluoride solution is easily contaminated by external agents; this leads to a marked reduction in the quantity of fluorine ions in solution, and ultimately to substandard results in fixing.

Contamination occurs, for example, through the presence of calcium ions; these form fluorides which precipitate and steal fluorine ions from the solution. Also, the solution contains aluminum ions that form fluoraluminate compounds, the effect of which is to render the fluorine ions unusable. Such, by way of example, are the principal sources of contamination to which the fixing solution is subject.

One expedient adopted in order to eliminate these difficulties consists in adding ammonia to induce precipitation of the aluminum and successively eliminate the precipitate, aluminum hydroxide, from the solution; the effectiveness of this method is offset by the drawback of its being long and laborious.

The object of the invention is to overcome the aforedescribed drawbacks through the provision of a system by means of which anodized aluminum fixing solutions can be purified simply, swiftly and economically, while maintaining the concentration of fluorine ions at prescribed levels.

SUMMARY OF THE INVENTION

The stated object is realized, together with other objects, with a system for fixing anodized aluminum surfaces according to the present invention. Such a system comprises a bath of nickel fluoride solution in which the items are immersed following anodization, and a recycle tank which is connected with the bath by way of flow and return pipelines; the tank contains a resin bed charged initially with negative fluorine ions and designed to effect a negative ion exchange.

The solution is circulated around the bath and the recycle tank by a pump for as long as ion exchange can be sustained, whereupon a regeneration device switches in to restore fluorine ions to the resin bed.

BRIEF DESCRIPTION OF THE DRAWINGS

The system according to the invention will now be described in detail, by way of example, with the aid of the accompanying drawing, which provides a schematic illustration of the essential components.

DESCRIPTION OF THE PREFERRED EMBODIMENTS

The system disclosed comprises a bath 1 filled with solution containing nickel fluoride added at a rate of 5 grams/liter approx.; in solution, the nickel fluoride dissociates into $Ni^{++}$ and $F^-$ ions. It is into this bath 1 that the anodized items to be fixed are introduced.

Inevitably, the bath 1 is a repository of certain contaminants such as calcium, aluminum, etc. which are carried in the solution in the event that this is not completely demineralized (often the case), or brought in either as traces of the preceding processes effected on the aluminum, or indeed by the aluminum itself. Such agents tend to steal fluorine ions from the solution, replacing them with other negative ions such as $Cl^-$ chlorine and $S04^-$ sulfate; in addition, there is a tendency toward the formation of $AlF^{---}$ type fluoraluminate ions.

2 denotes a tank accommodating ion exchange resins in a bed of conventional type, by which negative ions are exchanged; the resin is charged initially by the usual methods (shortly to be mentioned) with $F^-$ fluorine ions.

The tank 2 is connected to the bath 1 by way of a flow pipeline 4 and a return pipeline 5. A pump 3 installed on the flow line 4 permits of recycling the solution from the bath 1 through the tank 2 as and when required; more exactly, the solution is transferred by the pump 3 from the bath 1 to the tank 2 by way of the flow line 4, and restored to the bath from the tank by way of the return line 5. A conventional monitoring and control device 6 is used to verify the concentration of a selected ion at a given point along the return line 5; in the preferred embodiment described and illustrated, it is the concentration of $Cl^-$ chlorine ions that is monitored by the device 6.

Finally, 7 denotes a conventional regenerating device which, when operated, once the initial charge of fluorine ions has been exchanged wholly or in part, recharges the resin bed in the tank 2 with new fluorine ions (to be described in due course).

Operation of the system according to the invention will now be described.

First, it should be stated that the pump 3 can be operated either continuously or intermittently, at the user's discretion. The continuous mode is to be preferred, generally speaking, as this ensures a continuous purification of the solution contained in the bath 1.

The solution is pumped from the bath 1 through the tank 2, and thus brought into intimate contact with the resin bed; the resins have a particularly low affinity with the fluorine ion, so that this ion is retained far less readily than all other negative ions. Following passage of the solution through the tank 2, negative ions in the solution other than fluorine are retained by the resin bed, which for each negative ion captured releases one negative $F^-$ fluorine ion. In short, while in the bath 1 one has an exchange in which fluorine ions are taken from the solution and replaced by other negative ions, the exact opposite occurs in the tank 2, so that the concentration of fluorine ions in the bath 1 is maintained as required.

Throughout operation, a constant check is kept by way of the monitoring device 6 on the concentration of chlorine ions in the return pipeline 5; the fact of selecting the chlorine ion for control purposes is due to the ease and precision with which this particular ion can be monitored. Once the depletion of the charge of fluorine ions in the resin bed has reached a fairly advanced stage, the chlorine ions (always preponderant in number) will no longer be replaced as the solution passes through the tank 2; accordingly, their presence begins to register in the return pipeline 5, and once the concentration at the point sensed by the monitoring and control device 6 exceeds a given threshold, the device will shut off the recycle pump 3 and switch in a further pump 8, connecting the tank 2 to the regeneration device 7 which then proceeds to recharge the resin bed with F− negative fluorine ions.

Regeneration of the resin bed 2 can be effected using a variety of conventional media, from which the selection will in any case be made according to whether weak or strong resins are utilized. In a preferred system, sodium hydrate (NaOH) could first be introduced, followed by hydrofluoric acid (HF), and the bed then flushed.

Needless to say, the system will incorporate valves (not illustrated) to prevent any circulation of the solution through bath 1 and tank 2 while the resin bed is recharging.

In addition to the advantages already mentioned, a system as described and illustrated affords the facility of preparing a bath 1 with nickel salts far less costly than nickel fluoride; for instance, nickel sulfates might be utilized; in the example illustrated, indeed, it becomes possible to recycle the solution in such a way that S04−− ions brought into solution using nickel sulfate are exchanged entirely for F− ions, and whilst it is true that a solution of this kind imposes the requirement for more frequent, hence costlier regeneration of the resin bed, the overall cost of operating the system can nonetheless be reduced from that which would be incurred using a nickel fluoride solution for the fixing bath 1.

What is claimed:

1. A system for fixing anodized aluminum, comprising:

a bath (1) of nickel fluoride solution in which items of anodized aluminum are immersed;

a tank (2), connected with the bath (1) by a flow pipeline (4) and a return pipeline (5) and said tank containing a negative ion exchange resin bed charged initially with fluorine ions;

pump means (3) connected to said bath and said tank to recycle the solution contained in the bath by the flow line, the tank and the return line; and recharging means (7) connected to said tank to recharge the resin bed with fluorine ions when required.

2. A system as in claim 1, comprising a monitoring and control device (6) connected to said return pipeline to monitor the concentration of a given ion through the return pipeline.

3. A system as in claim 2, wherein the monitoring and control device includes means to monitor the concentration of chlorine ions.

4. A system as in claim 2, wherein the recharging means (7) is operatively connected to the monitoring and control device (6).

* * * * *